US005426787A

United States Patent [19]

Freeman

[11] Patent Number: 5,426,787

[45] Date of Patent: Jun. 27, 1995

[54] KARATE UNIFORM WITH HOOK AND LOOP CLOSURE

[76] Inventor: LeeAnn Freeman, 1517 Andrea Dr., Sierra Vista, Ariz. 85635

[21] Appl. No.: 297,382

[22] Filed: Aug. 29, 1994

[51] Int. Cl.[6] ..... A41D 1/00; A41F 1/00; A44B 18/00

[52] U.S. Cl. ..... 2/69; 2/336; 2/96; 2/121; 24/442

[58] Field of Search ..... 2/69, 2, 1, 83, 78.4, 2/92, 96, 88, 115, 114, 50, 51, 104, 120, 121, 128, 102, 84, 94, 108, 318, 321, 118, 913, 914, 336, 337, 338; 24/306, 442

[56] References Cited

U.S. PATENT DOCUMENTS

| | | | |
|---|---|---|---|
| 949,164 | 2/1910 | Tyrrell | 2/93 X |
| 1,139,999 | 5/1915 | Rosenthal | 2/77 |
| 2,058,367 | 10/1936 | Steiner | 2/128 |
| 2,686,914 | 8/1954 | Weiser | 2/114 |
| 4,275,513 | 6/1981 | Antonious | 24/306 X |
| 4,658,442 | 4/1987 | Tomlinson et al. | 2/102 X |

*Primary Examiner*—Clifford D. Crowder

*Assistant Examiner*—Shirra Jenkins

[57] ABSTRACT

A new and improved karate uniform with an upper uniform component having an inner surface, an outer surface, a back portion, a right sleeve portion, a right body portion, a left sleeve portion, a left body portion, a collar portion, a right lapel, and a left lapel. Also, a first cloth loop having a U-shaped configuration is secured to the right body portion of the upper uniform component. A first hook strap has a first end that is secured to the left lapel of the left body portion of the upper uniform component. A second end has a first pile fastener and a second pile fastener thereon. The first hook strap serves to cooperate with the first cloth loop to keep the uniform closed around a user. Also, a second cloth loop having a U-shaped configuration is secured to the left body portion of the upper uniform component. A second hook strap first end is secured to the right lapel of the right body portion of the upper uniform component. A second end has a first pile fastener and a second pile fastener thereon. The second hook strap serves to cooperate with the second cloth loop to keep the uniform closed around a user.

2 Claims, 4 Drawing Sheets

KARATE UNIFORM WITH HOOK AND LOOP CLOSURE

BACKGROUND OF THE INVENTION

1. Field of the Invention

The present invention relates to a karate uniform and more particularly pertains to closing a top portion of the karate uniform with a pile fastener with a karate uniform.

2. Description of the Prior Art

The use of uniforms is known in the prior art. More specifically, uniforms heretofore devised and utilized for the purpose of providing adequate uniforms for karate participants are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 319,525 to Clark discloses the ornamental design for a uniform for martial arts or the like.

U.S. Pat. No. 5,060,314 to Lewis discloses a multi-mission ballistic resistant jacket.

U.S. Pat. No. 4,389,733 to Boykins, Jr. discloses a uniform for karate and the like.

U.S. Pat. No. 3,866,909 to DeSantis discloses a protective garment for karate with force indicating members thereon.

U.S. Pat. No. 5,170,505 to Rohrer discloses an expandable children's clothing.

While these devices fulfill their respective, particular objective and requirements, the aforementioned patents do not describe a karate uniform that closes a top portion of the karate uniform with a pile fastener.

In this respect, the karate uniform according to the present invention substantially departs from the conventional concepts and designs of the prior art, and in doing so provides an apparatus primarily developed for the purpose of closing a top portion of the karate uniform with a pile fastener.

Therefore, it can be appreciated that there exists a continuing need for a new and improved karate uniform which can be used for closing a top portion of the karate uniform with a pile fastener. In this regard, the present invention substantially fulfills this need.

SUMMARY OF THE INVENTION

In the view of the foregoing disadvantages inherent in the known types of uniforms now present in the prior art, the present invention provides an improved karate uniform. As such, the general purpose of the present invention, which will be described subsequently in greater detail, is to provide a new and improved karate uniform and method which has all the advantages of the prior art and none of the disadvantages.

To attain this, the present invention essentially comprises an upper uniform component having an inner surface, an outer surface, a back portion, a right sleeve portion, a right body portion, a left sleeve portion, a left body portion, and a collar portion. The right body portion comprises the inner flap. The left body portion comprises the outer flap. The right body portion has a first edge and a second edge. A right lapel is secured to the second edge. The right lapel has an inner surface and an outer surface. The left body portion has a first edge and a second edge. A left lapel is secured to the second edge of the left body portion. The left lapel has an inner surface and an outer surface. The device contains a first cloth loop having a U-shaped configuration. The loop has two end portions and an intermediate loop extending outwardly therebetween. The two end portions are secured to the outer surface of the first edge of the right body portion of the upper uniform component. The device contains a first hook strap having a first end and a second end. The first end is secured to the inner surface of the left lapel of the left body portion of the upper uniform component. The second end has a first pile fastener secured thereon. A second pile fastener is secured inward of the first pile fastener. The first hook strap serves to cooperate with the first cloth loop to keep the uniform closed around a user. The device contains a second cloth loop having a U-shaped configuration. The loop has two end portions and an intermediate loop extending outwardly therebetween. The two end portions are secured to the inner surface of the left body portion of the upper uniform component. The device also contains a second hook strap having a first end and a second end. The first end is secured to the outer surface of the right lapel of the right body portion of the upper uniform component. The second end has a first pile fastener secured thereon. A second pile fastener is secured inward of the first pile fastener. The second hook strap serves to cooperate with the second cloth loop to keep the uniform closed around a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved karate uniform which has all the advantages of the prior art uniforms and none of the disadvantages.

It is another object of the present invention to provide a new and improved karate uniform which may be easily and efficiently manufactured and marketed.

It is a further object of the present invention to provide a new and improved karate uniform which is of durable and reliable construction.

An even further object of the present invention is to provide a new and improved karate uniform which is susceptible of a low cost of manufacture with regard to both materials and labor, and which accordingly is then susceptible of low prices of sale to the consuming public, thereby making such a karate uniform economically available to the buying public.

Still yet another object of the present invention is to provide a new and improved karate uniform which provides in the apparatuses and methods of the prior art some of the advantages thereof, while simultaneously overcoming some of the disadvantages normally associated therewith.

Even still another object of the present invention is to provide a new and improved karate uniform for closing a top portion of the karate uniform with a pile fastener.

Lastly, it is an object of the present invention to provide a new and improved karate uniform with an upper uniform component having an inner surface, an outer surface, a back portion, a right sleeve portion, a right body portion, a left sleeve portion, a left body portion, a collar portion, a right lapel, and a left lapel. Also, a first cloth loop having a U-shaped configuration is secured to the right body portion of the upper uniform component. A first hook strap has a first end that is secured to the left lapel of the left body portion of the upper uniform component. A second end has a first pile fastener and a second pile fastener thereon. The first hook strap serves to cooperate with the first cloth loop to keep the uniform closed around a user. Also, a second cloth loop having a U-shaped configuration is secured to the left body portion of the upper uniform component. A second hook strap first end is secured to the right lapel of the right body portion of the upper uniform component. A second end has a first pile fastener and a second pile fastener thereon. The second hook strap serves to cooperate with the second cloth loop to keep the uniform closed around a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
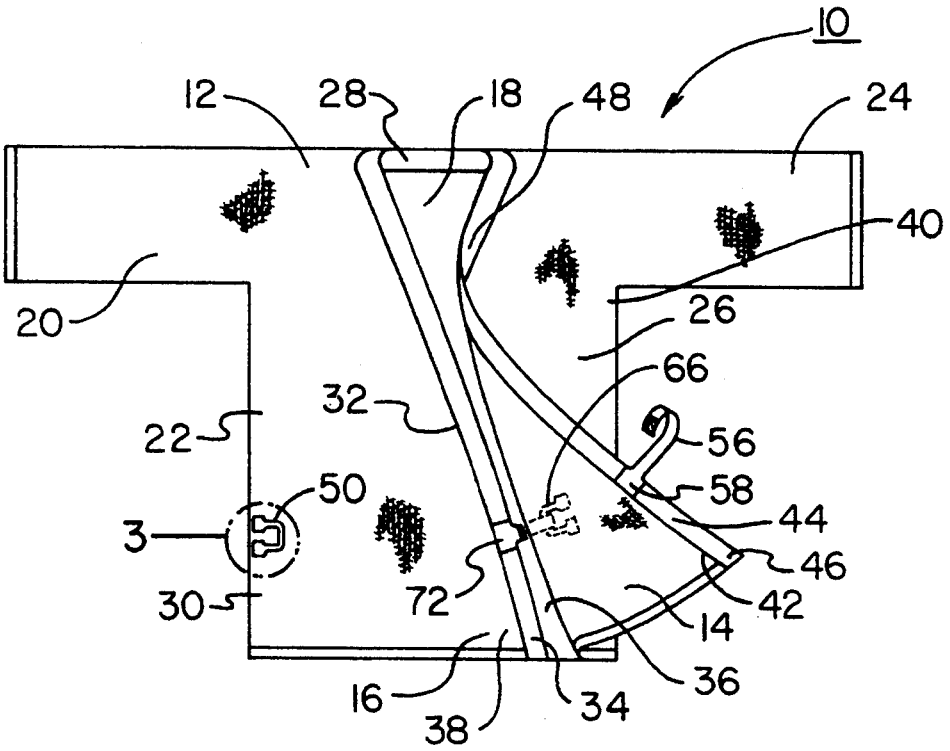
FIG. 1 is a perspective view of the preferred embodiment of the karate uniform constructed in accordance with the principles of the present invention.
Figure 2:
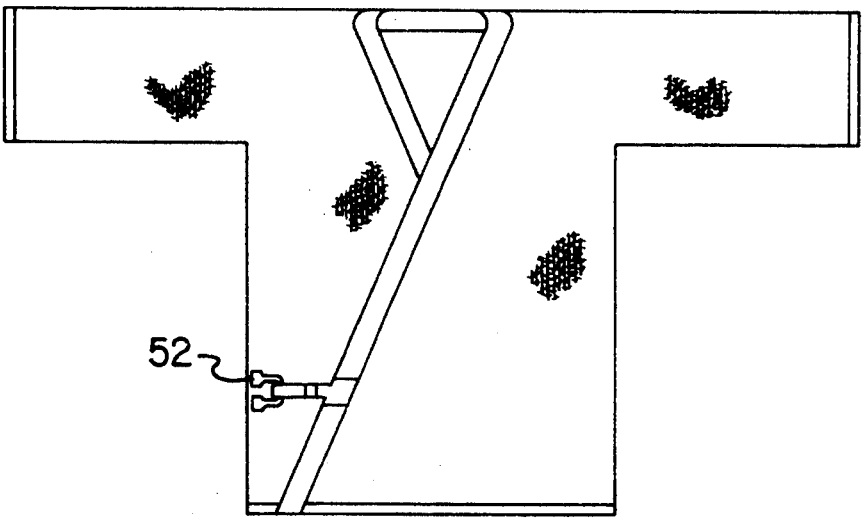
FIG. 2 is a front view of the present invention showing the uniform in its closed position.
Figure 3:
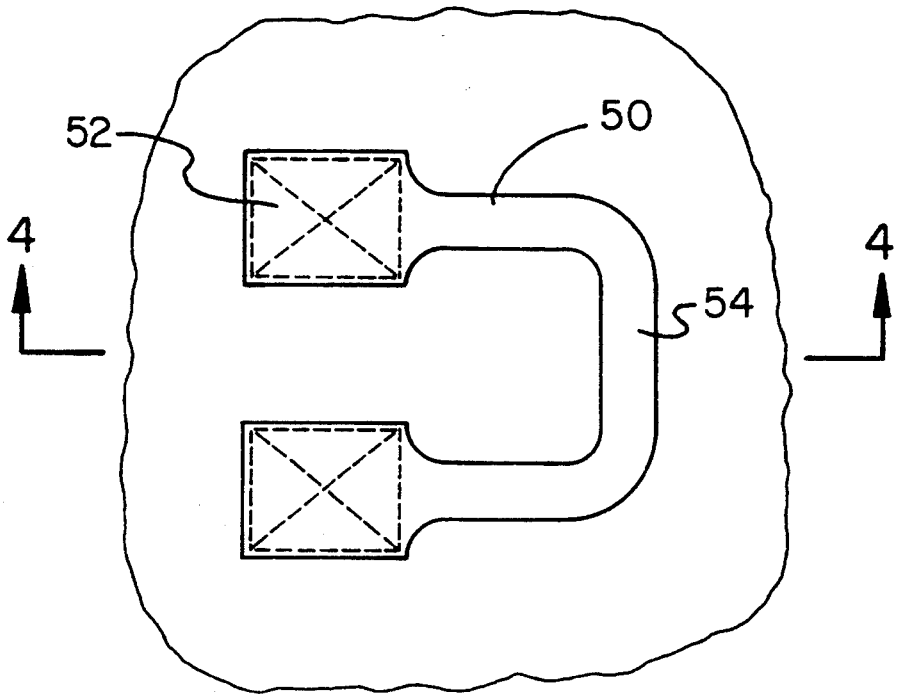
FIG. 3 is an enlarged front view of the cloth loop as seen in FIG. 1.
Figure 4:
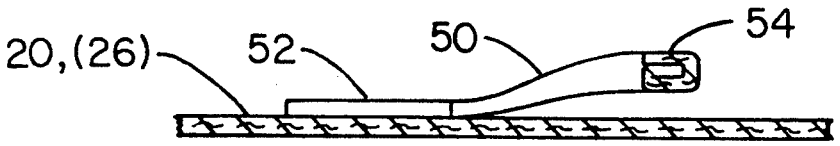
FIG. 4 is a cross-sectional view of the cloth loop as seen along line 4—4 of FIG. 3.
Figure 5:
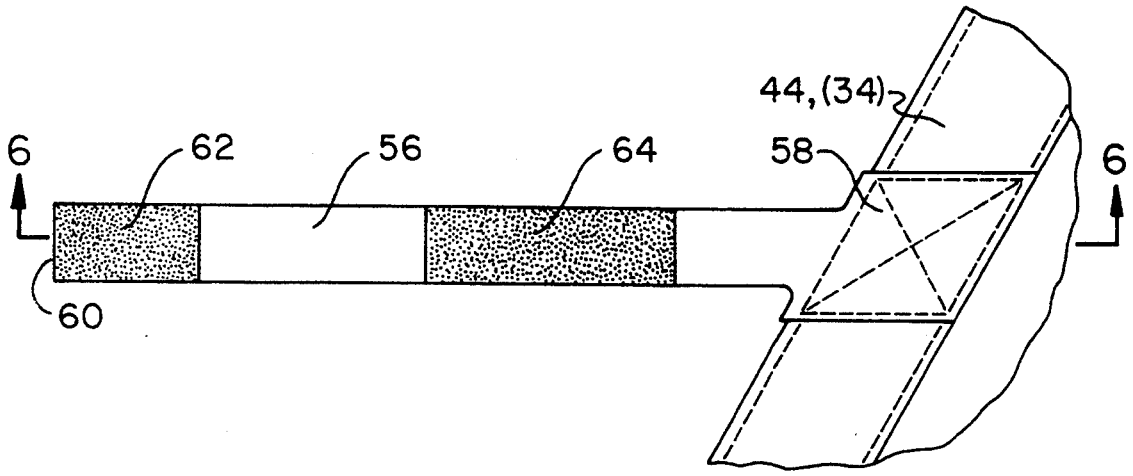
FIG. 5 is an enlarged view of the cloth strap of the present invention.
Figure 6:
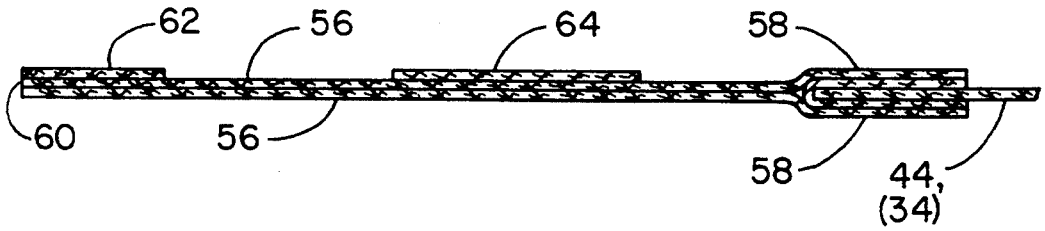
FIG. 6 is a cross-sectional view of the present invention as seen along line 6—6 of FIG. 5.
Figure 7:
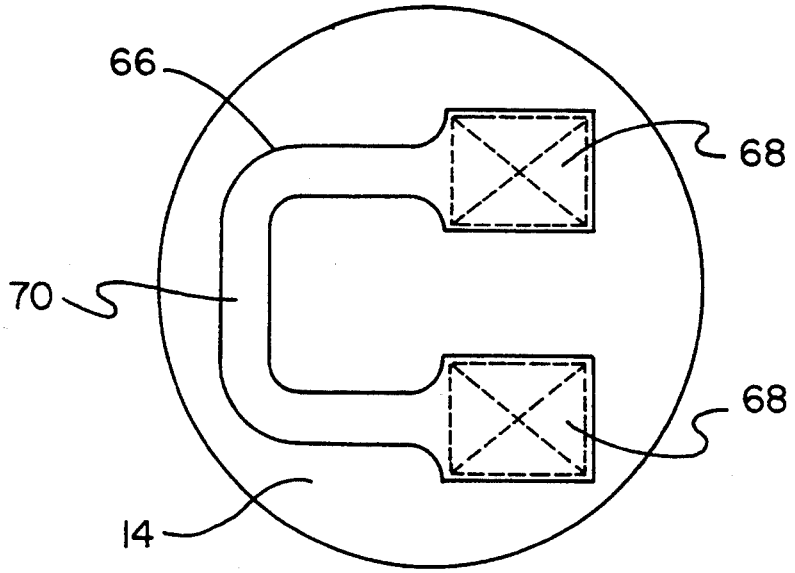
FIG. 7 is a view similar to FIG. 3 but showing the other loop.
Figure 8:
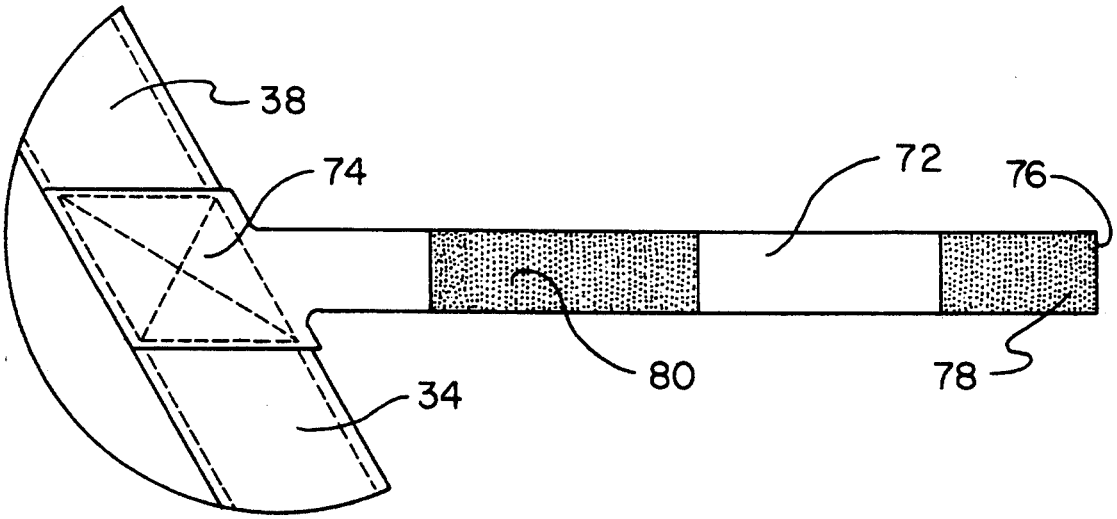
FIG. 8 is a view similar to FIG. 5 but showing the other strap.

With reference now to the drawings, and in particular, to FIG. 1 thereof, the preferred embodiment of the new and improved karate uniform embodying the principles and concepts of the present invention and generally designated by the reference number 10 will be described.

Specifically, it will be noted in the various Figures that the device relates to a new and improved karate uniform for closing a top portion of the karate uniform with a pile fastener. In its broadest context, the device consists of an upper uniform component, a first cloth loop, a first hook strap, a second cloth loop, and a second hook strap.

The device 10 contains an upper uniform component 12 having an inner surface 14, an outer surface 16, a back portion 18, a right sleeve portion 20, a right body portion 22, a left sleeve portion 24, a left body portion 26, and a collar portion 28. The right body portion 22 comprises the inner flap. The left body portion 26 comprises the outer flap. The right body portion 22 has a first edge 30 and a second edge 32. A right lapel 34 is secured to the second edge 32. The right lapel 34 has an inner surface 36 and an outer surface 38. The left body portion 26 has a first edge 40 and a second edge 42. A left lapel 44 is secured to the second edge 42 of the left body portion 26. The left lapel 44 has an inner surface 46 and an outer surface 48. The upper uniform component 12 strongly resembles the standard uniforms that are used by karate enthusiasts today, the only missing elements from the standard uniforms are the small strings that are used to keep the right body portion 22 secured to the left body portion 26. The present invention has established a more effective means for this securement.

The device 10 contains a first cloth loop 50 having a U-shaped configuration. The loop has two end portions 52 and an intermediate loop 54 extending outwardly therebetween. The two end portions 52 are secured to the outer surface 16 of the first edge 30 of the right body portion 22 of the upper uniform component 12.

The device 10 contains a first hook strap 56 having a first end 58 and a second end 60. The first end 58 is secured to the inner surface 46 of the left lapel 44 of the left body portion 26 of the upper uniform component 12. The second end 60 has a first pile fastener 62 secured thereon. A second pile fastener 64 is secured inward of the first pile fastener 62. The first hook strap 56 serves to cooperate with the first cloth loop 50 to keep the uniform closed around a user. The strap 56 is fitted through the loop 56 and the first pile fastener 62 is matched with the second pile fastener 64 to give the user a tightly secure means of keeping the inner flap secured to the outer flap.

The device 10 contains a second cloth loop 66 having a U-shaped configuration. The loop has two end portions 68 and an intermediate loop 70 extending outwardly therebetween. The two end portions 68 are secured to the inner surface 14 of the left body portion 26 of the upper uniform component 12.

The device 10 also contains a second hook strap 72 having a first end 74 and a second end 76. The first end 74 is secured to the outer surface 38 of the right lapel 34 of the right body portion 22 of the upper uniform component 12. The second end 76 has a first pile fastener 78 secured thereon. A second pile fastener 80 is secured inward of the first pile fastener 78. The second hook strap 72 serves to cooperate with the second cloth loop 66 to keep the uniform closed around a user. As with the first strap and the first loop, the second strap 72 is fitted through the loop 66 and the first pile fastener 78 is matched with the second pile fastener 80 to give the user another tightly secure means of keeping the inner flap secured to the outer flap. The strap and hoop replace the conventional strings to give the user a better securement means for their uniform. Instead of always worrying about their uniform strings coming loose the strap and hoop allow the user to concentrate on their martial arts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved karate uniform for closing a top portion of the karate uniform with a pile fastener comprising, in combination:

an upper uniform component having an inner surface, an outer surface, a back portion, a right sleeve portion, a right body portion, a left sleeve portion, a left body portion, and a collar portion, the right body portion comprising the inner flap, the left body portion comprising the outer flap, the right body portion having a first edge and a second edge, a right lapel secured to the second edge, the right lapel having an inner surface and an outer surface, the left body portion having a first edge and a second edge, a left lapel secured to the second edge of the left body portion, the left lapel having an inner surface and an outer surface;

a first cloth loop having a U-shaped configuration, the loop having two end portions and an intermediate loop extending outwardly therebetween, the two end portions secured to the outer surface of the first edge of the right body portion of the upper uniform component;

a first hook strap having a first end and a second end, the first end secured to the inner surface of the left lapel of the left body portion of the upper uniform component, the second end having a first pile fastener secured thereon, a second pile fastener secured inward of the first pile fastener, the first hook strap serving to cooperate with the first cloth loop to keep the uniform closed around a user;

a second cloth loop having a U-shaped configuration, the loop having two end portions and an intermediate loop extending outwardly therebetween, the two end portions secured to the inner surface of the left body portion of the upper uniform component; and a second hook strap having a first end and a second end, the first end secured to the outer surface of the right lapel of the right body portion of the upper uniform component, the second end having a first pile fastener secured thereon, a second pile fastener secured inward of the first pile fastener, the second hook strap serving to cooperate with the second cloth loop to keep the uniform closed around a user.

2. A karate uniform for closing a top portion of the karate uniform with a pile fastener comprising:

an upper uniform component having an inner surface, an outer surface, a back portion, a right sleeve portion, a right body portion, a left sleeve portion, a left body portion, a collar portion, a right lapel, and a left lapel;

a first cloth loop having a U-shaped configuration secured to the right body portion of the upper uniform component;

a first hook strap having a first end secured to the left lapel of the left body portion of the upper uniform component, a second end having a first pile fastener and a second pile fastener, the first hook strap serving to cooperate with the first cloth loop to keep the uniform closed around a user;

a second cloth loop having a U-shaped configuration secured to the left body portion of the upper uniform component; and a second hook strap first end secured to the right lapel of the right body portion of the upper uniform component, a second end having a first pile fastener and a second pile fastener, the second hook strap serving to cooperate with the second cloth loop to keep the uniform closed around a user.

* * * * *